US008196249B1

(12) United States Patent
Spooner et al.

(10) Patent No.: US 8,196,249 B1
(45) Date of Patent: Jun. 12, 2012

(54) CLEANING IMPLEMENT

(75) Inventors: Gregory Clegg Spooner, Causeway Bay (HK); Christopher James Mccaughan Hay, Causeway Bay (HK); Benjo Lapuebla Manuel, Causeway Bay (HK); Caroline Maree Francis, Beijing (CN)

(73) Assignee: Hayco Manufacturing Limited, Causeway Bay (HK)

( * ) Notice: Subject to any disclaimer, the term of this patent is extended or adjusted under 35 U.S.C. 154(b) by 985 days.

(21) Appl. No.: 12/154,461

(22) Filed: May 23, 2008

(51) Int. Cl.
*A47L 13/11* (2006.01)
*A47L 13/12* (2006.01)

(52) U.S. Cl. ..... 15/117

(58) Field of Classification Search ..... 15/117
See application file for complete search history.

(56) References Cited

U.S. PATENT DOCUMENTS

| | | | | | |
|---|---|---|---|---|---|
| 1,982,345 | A | * | 11/1934 | Kirby | 15/321 |
| 2,741,788 | A | * | 4/1956 | Shey | 401/25 |
| 2,832,980 | A | * | 5/1958 | O'Neill | 401/27 |
| 2,896,241 | A | * | 7/1959 | Cotman | 15/184 |
| 3,619,845 | A | * | 11/1971 | Partridge | 15/117 |
| 5,940,924 | A | * | 8/1999 | Williams et al. | 15/115 |

* cited by examiner

*Primary Examiner* — Randall Chin
(74) *Attorney, Agent, or Firm* — Renner Kenner; Greive Bobak; Taylor & Weber

(57) ABSTRACT

A cleaning implement in the form of a combined brush and squeegee with a head member (2) with bristle (4) extending from the head member and a handle (7), where a squeegee blade (8) is movably supported on the head member (2). An extension mechanism (14) is operable by a user to extend or retract the squeegee blade member (8) relative to the head member (2) in a direction generally parallel to the extent of the bristles (4).

13 Claims, 14 Drawing Sheets

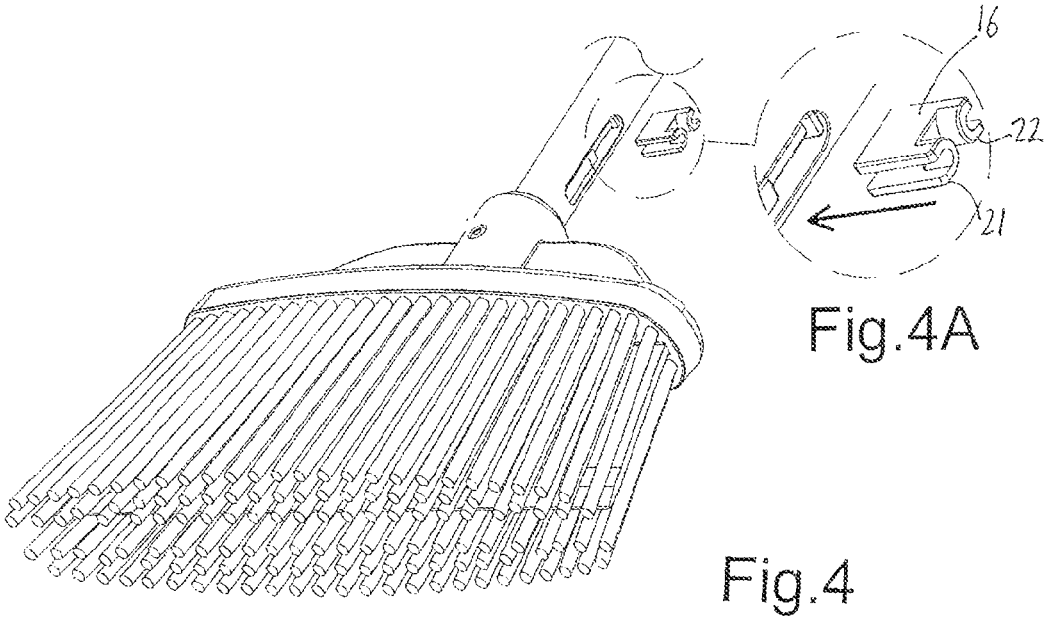
Fig.4A
Fig.4
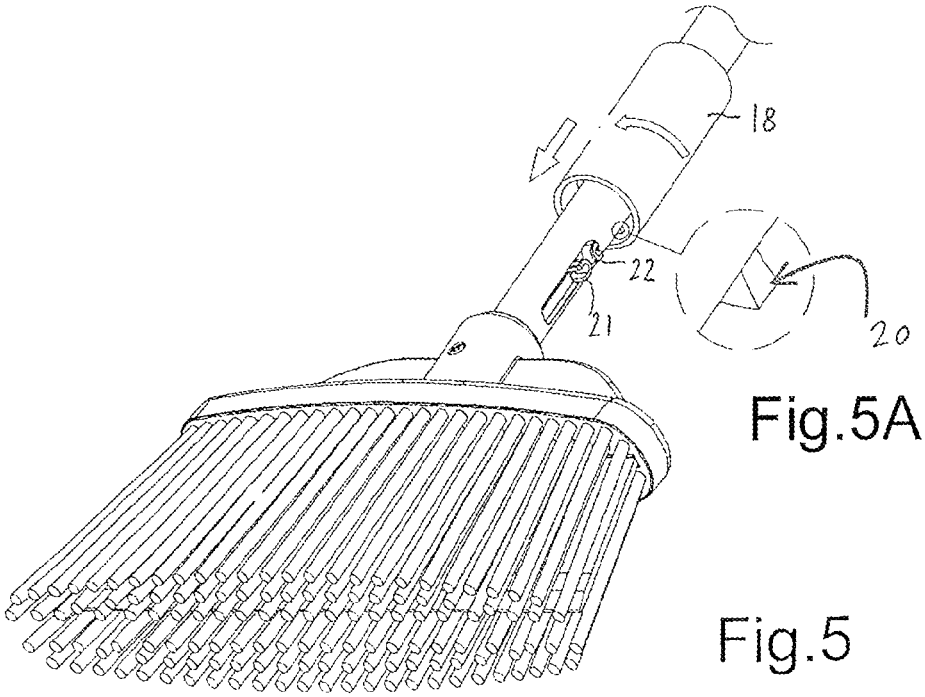
Fig.5A
Fig.5

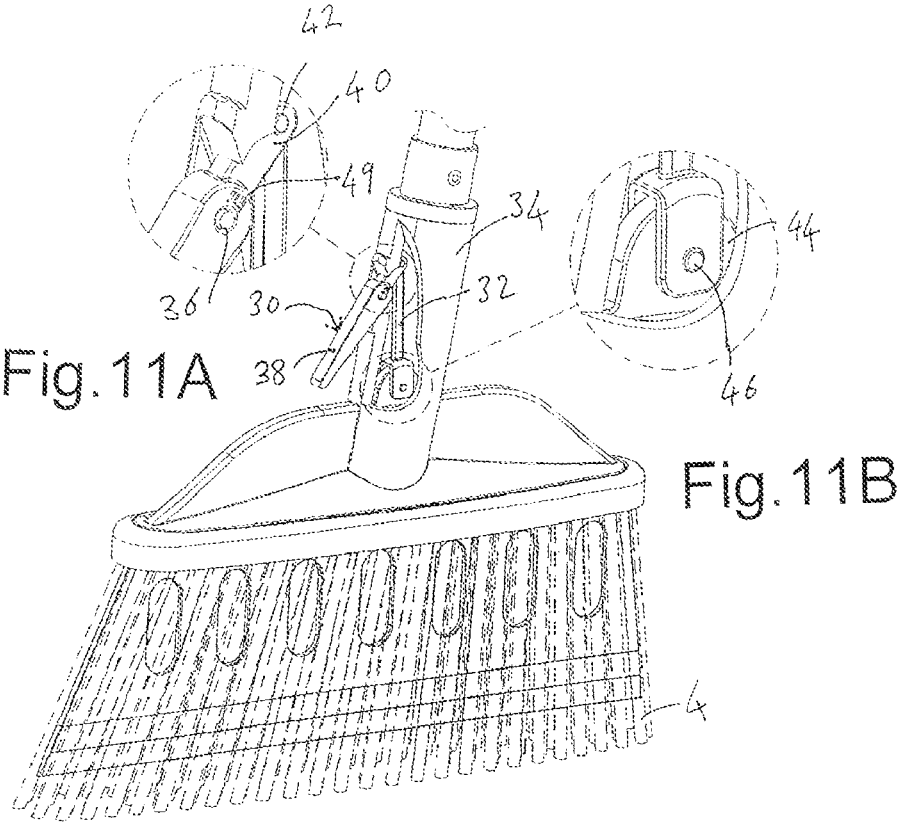
Fig.11A
Fig.11B
Fig.11
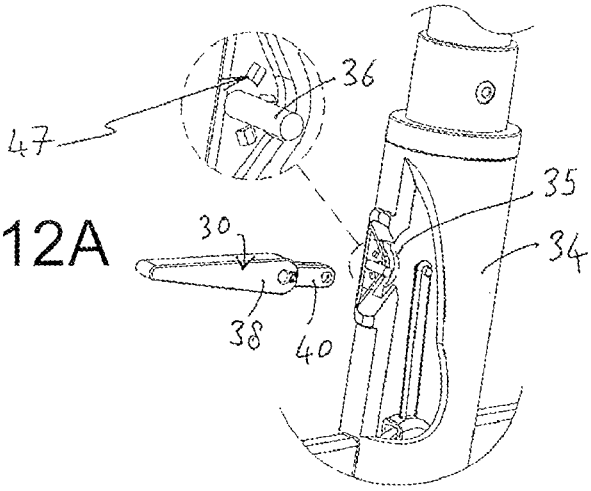
Fig.12A
Fig.12

CLEANING IMPLEMENT

BACKGROUND OF THE INVENTION

The present invention relates to a cleaning implement in the form of a combined brush and squeegee.

It is well-known to provide squeegees for use in cleaning applications where a large amount of water is present for example when cleaning windows, or for removing water either cleaning water or collected rainwater from surfaces such as patios or pavements, or from beside swimming pools. In such squeegees a flexible blade is secured at an edge to a rigid blade mount, which depending on the application may have a long or short handle secured thereto.

The present invention is directed to an implement incorporating a squeegee into an article of brushware.

SUMMARY OF THE INVENTION

The invention relates to a cleaning implement which has a head member from which a plurality of bristles extend, with a handle joined to the bristle head. A squeegee blade member is supported within or adjacent the bristles as to be extendable and retractable in a direction generally parallel to the extent of the bristles.

The extent of travel of the blade member may be such that it is movable between an extended position in which a lower blade edge extends beyond the ends of the bristles, and a retracted position in which the lower blade edge is withdrawn into or beside the bristles and spaced from the bristle ends.

An extension mechanism is provided by which the user can effect movement of the squeegee blade member. In one embodiment the extension mechanism comprises an outer sleeve member having a helical cam surface, which is rotatably mounted on the handle or a handle-receiving socket of the head which engages with a cam follower on an internal drive member connected to the squeegee blade member, whereby rotation of the outer sleeve member effects linear movement of the shaft portion and squeegee blade member. The squeegee member may be provided at an upper end with a shaft portion which extends through an opening in the head member to connect with the internal drive member. The cam surface is preferably formed as an inwardly protruding helical surface, the cam follower comprising a protrusion or pair of protrusions which abut the helical cam surface, but could equally be formed as a recessed track within the sleeve, the cam follower comprising a protrusion engaged within the track.

A detent structure may be provided to allow the squeegee blade member to be held in and moved between predefined positions. To this end a detent arrangement may be provided between the outer sleeve and a part of the handle.

In an alternative construction the extension mechanism comprises a pivotally mounted lever having a first end which is accessible by a user and an opposite end which is joined to the squeegee blade member. A link arm may be provided to join the lever to the squeegee blade. Preferably the lever is pivotally supported on a socket portion upstanding from the brush head, extending through a slot with the socket portion.

Again a detent structure may be provided, whereby the lever can be constrained in one or more predetermined positions; for example, the lever may have one or more recesses or protrusions which engage in cooperating protrusions or recesses within a wall of the socket adjacent the slot.

In a still further alternative arrangement the extension mechanism comprises a slide member slidably mounted on the handle or head member, an end of which is joined to the squeegee blade member. This may be mounted within an upstanding socket of the head member, the socket defining an elongate slot-like opening, through which a user-controllable thumb grip extends. One or detent positions may be defined between the thumb grip portion and adjacent slot wall. To this end the thumb grip may have a pair of oppositely directed protrusions which engage in one or more recesses with the slot walls. The slide member may also define a pair of axially-extending slots on opposite side of a central region, said thumb grip portion being provided on this central region, whereby the thumb grip can be bent inwardly so that the protrusions clear the detent recesses.

BRIEF DESCRIPTION OF THE DRAWINGS

Embodiments of the invention are now described by way of example only, with references to the following drawings in which:

FIG. 4 shows an assembly step of a drive member being fixed to a drive shaft;

FIG. 4A is an enlarged view of the drive member of FIG. 4;

FIG. 5 shows an assembly step of securing a sleeve member;

FIG. 5A is an enlarged view of a cam surface of the sleeve of FIG. 5;

FIG. 11 is an enlarged view of the head and extension mechanism of the second embodiment, partly cut-away;

FIG. 11A is an enlarged view of a part of the extension mechanism of FIG. 11;

FIG. 11B is an enlarged view of another part of the extension mechanism of FIG. 11;

FIG. 12 is an enlarged view of the extension mechanism with lever disassembled;

FIG. 12A is an enlarged view of a part of the extension mechanism of FIG. 12;

FIGS. 13(*a*)A and 13(*b*)A are enlarged views of a part of the extension mechanism during progressive extension of the squeegee blade as shown in FIGS. 13(*a*) and (*b*);

FIG. 16(*a*)A is an enlarged view of a part of the extension mechanism of the combined brush/squeegee of FIG. 16(*a*).

DETAILED DESCRIPTION OF THE PREFERRED EMBODIMENTS

Figures 1, 1A:
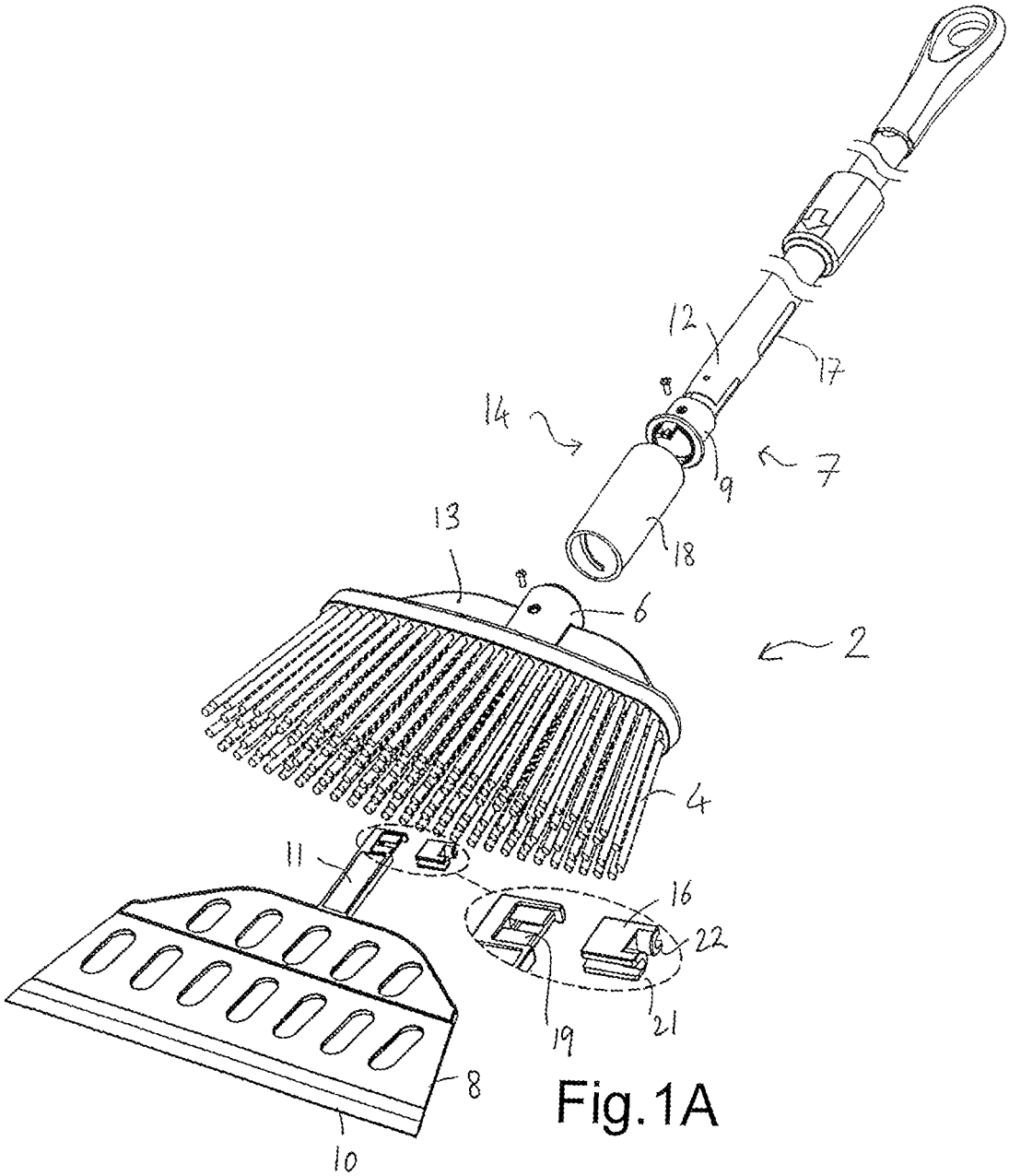
FIG. 1 is an exploded view of a cleaning implement in the form of a combined brush/squeegee in accordance with a first embodiment of the invention.
FIG. 1A is an enlarged view of a part of the combined brush/squeegee of FIG. 1.

Turning to the drawings, FIGS. 1 and 1A show a cleaning implement according to a first embodiment of the invention, in the form of a combined brush/squeegee. The implement comprises a brush head 2 from which depend a plurality of bristles 4, which may be secured to the head by a variety of means such as staples, adhesive, etc., as is well-known. Upstanding from the head 2 is a hollow tubular socket 6 which receives a lower end of handle 7 as is discussed further below.

Arranged within the bristles 4 is a squeegee blade 8 in the form of a planar member of a flexible material such as a synthetic rubber-like material having a lower edge 10 which in section tapers to a region of reduced thickness, whereby the lower edge 10 in particular has significant flexibility. Although the squeegee blade is illustrated as extending from within the bristles surrounded on both faces by bristles, it might equally be arranged adjacent the bristles, that is with bristles on one side only. An upper end of the squeegee blade 8 has a short shaft portion 11 which extends through an opening into the socket 6. The squeegee blade 8 is supported so as to be movable in the direction of extent of the handle 7, whereby the blade moves in a direction parallel to the extent of the bristles 4. The head 2 may be formed with web-like regions 13 which contribute to the rigidity of the head 2 and which may be hollow to receive upper edges of the squeegee blade 8 when fully retracted.

Handle 7 comprises, at least at its lower end, a hollow tubular wall 12. At this lower end of the handle 7 an extension mechanism 14 is provided by which the squeegee blade 8 can be extended or retracted relative to the head 2 and bristles 4. This extension mechanism 14 includes a drive member 16 which is joined to an upper end of the shaft 11 and which protrudes laterally through a slot 17 in the wall 12 as best seen in FIGS. 4, 4A, 5, 5A, 7 and 7A. This member 16 is conveniently formed as an insert having a laterally extending slot by which it can be received over a recessed region 19 of the shaft 11, and includes a pair of pin-like protrusions 21, 22 which protrude through the handle slot 17 and which define a small clearance therebetween. The member 16 may be arranged to make a snap-fit connection within recessed region 19.

Although the handle-receiving socket 6 is shown as a short tubular section it may be enlarged sufficiently that the extension mechanism is arranged in the socket, rather than in the handle (as is illustrated with respect to the second and third embodiments discussed below).

An outer sleeve 18 is provided arranged between the socket 6 and a collar 9 secured, on the handle 7 at a position spaced from its lower end, and which surrounds the lower end of the handle at the position of the slot 17. This sleeve 18 is provided with an inwardly protruding helical cam surface 20 which spirals around the internal surface of the sleeve 18. This cam surface is disposed between the pair of protrusions 21, 22 which constitute cam followers. Rotation of the sleeve 18 causes the drive member 16 to be driven down or up the handle thereby extending or retracting the squeegee blade 8.

Although the outer sleeve 18 is provided with the protruding cam surface 20 it will be appreciated that this could equally be arranged as a recessed track into which a protrusion of the cam follower is received.

Figure 9A:
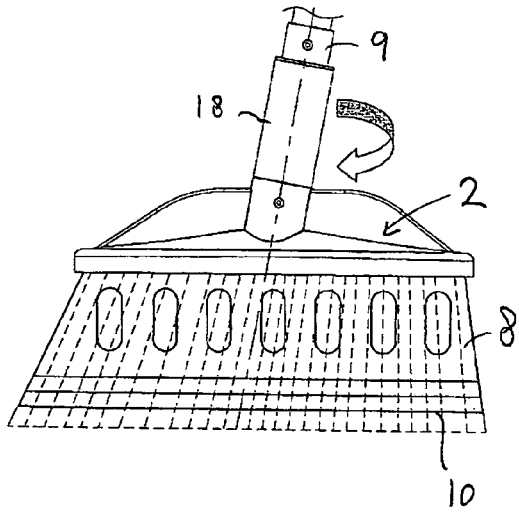
FIGS. 9(*a*), (*b*) and (*c*) illustrate the extension of a squeegee blade from the combined brush/squeegee.
Figure 9B:
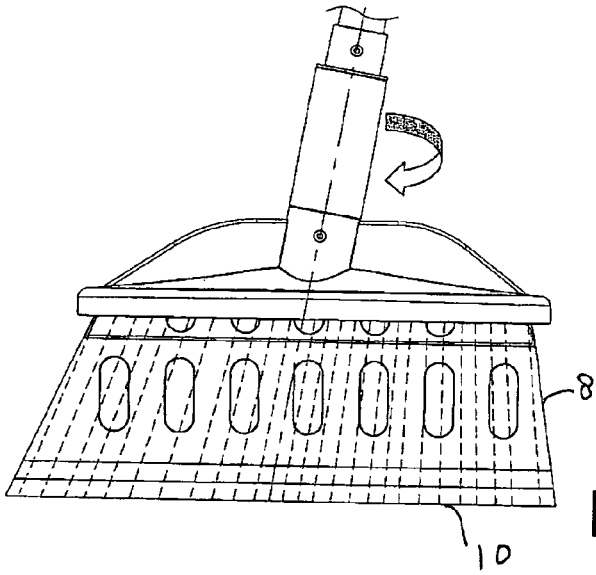
Figure 9C:
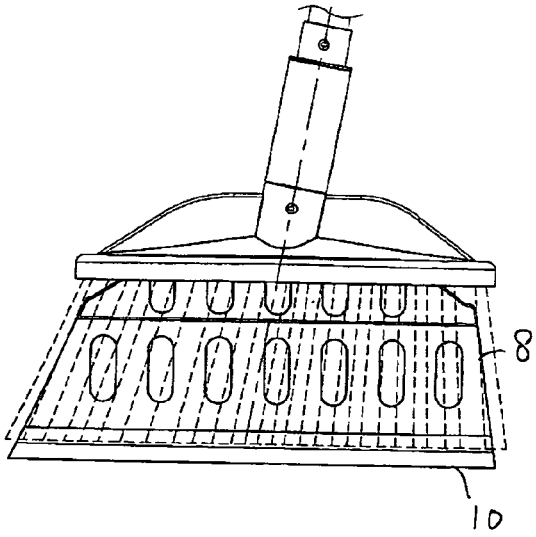
Figure 10:
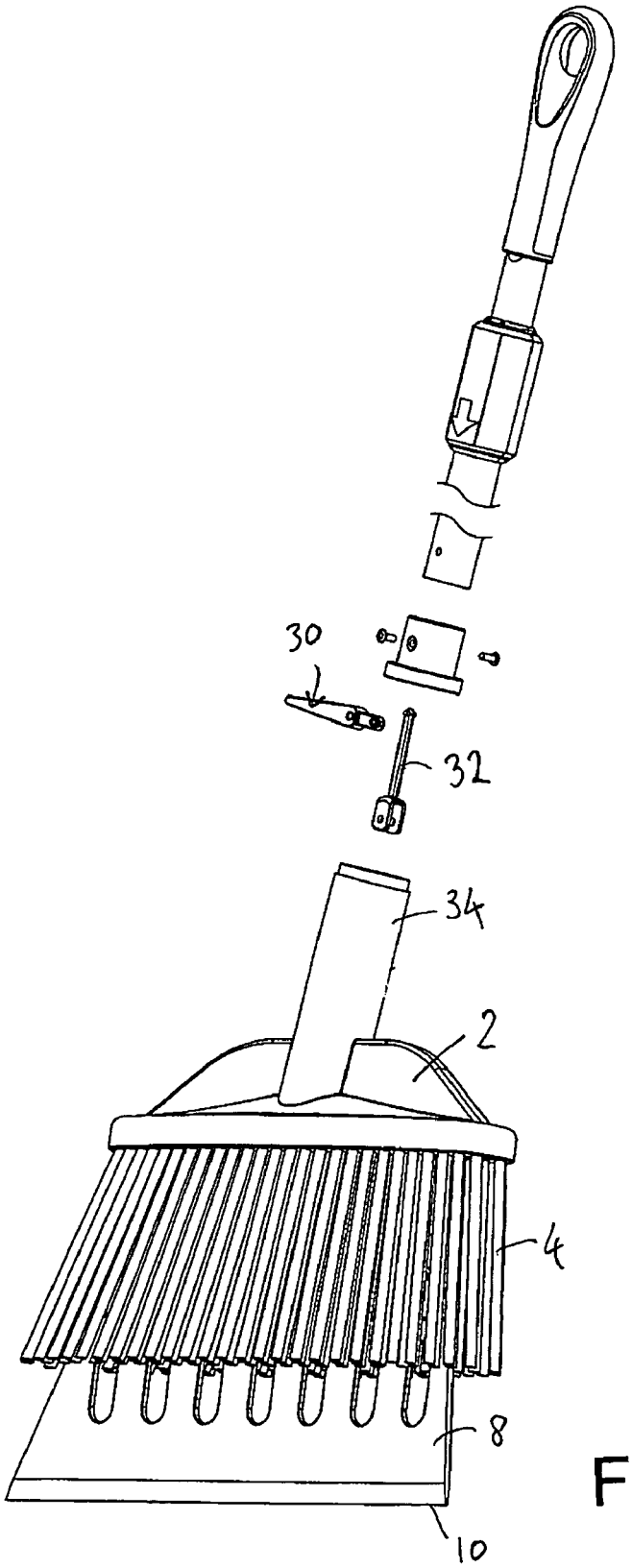
FIG. 10 is an exploded view of a cleaning implement in the form of a combined brush/squeegee in accordance with a second embodiment of the invention.

It is preferably arranged that the range of travel of the squeegee blade 8 is between an upper position (FIG. 9(*a*)) where the lower blade edge 10 is spaced from the lower ends of the bristles, through an intermediate position (FIG. 9(*b*)) where the blade edge 10 is generally coplanar with the bristle ends, to a position (FIG. 9(*c*)) where the blade edge protrudes beyond the bristle ends.

These positions provide the implement with different attributes. In an upper position with the blade 8 retracted the implement functions predominantly as a brush. Indeed, it may be arranged that the blade is movable over a significant distance of travel with the blade edge 10 retracted and spaced from the bristle ends. Varying the position of the blade edge 10 has the effect of varying the properties of the brush; as the blade edge is more distant from the bristle ends the bristles behave as a less stiff brush, owing to the greater moment of force acting on them during a brushing operating. A less stiff brush is particularly useful for sweeping up finer particles of dust and dirt. As the blade edge 10 moves towards the bristle ends the bristles become effectively more stiff as the bending moment decreases, which is beneficial for sweeping up more coarse particles.

At the intermediate position of FIG. 9(*b*) the implement may function as both a brush and squeegee. At the lower position of FIG. 9(*c*) with the blade edge 10 extended beyond the bristles the implement functions predominantly as a squeegee.

Figures 6, 6A:
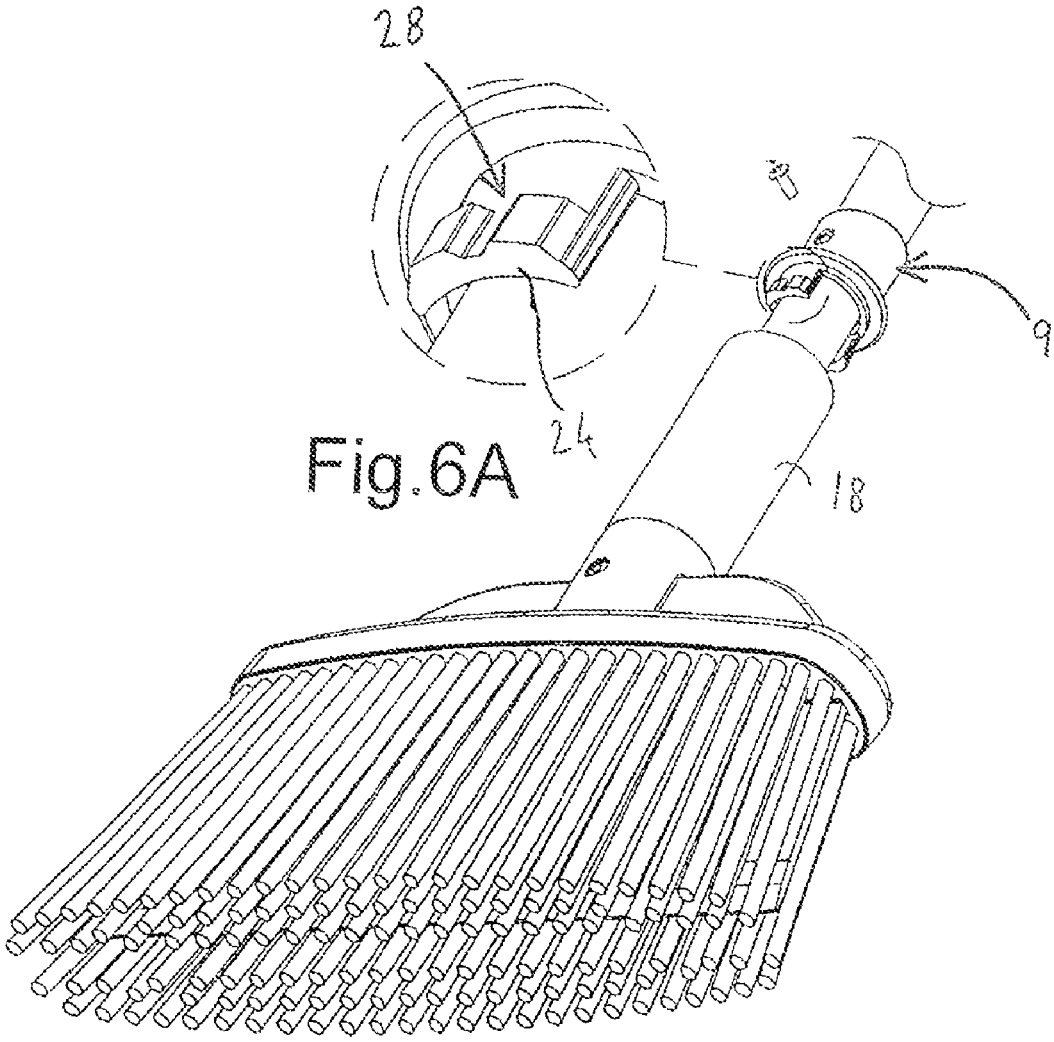
FIG. 6 shows an assembly step of securing a collar and detent.
FIG. 6A is an enlarged view of detent formations and a detent groove on the collar of FIG. 6.
Figures 7, 7A:
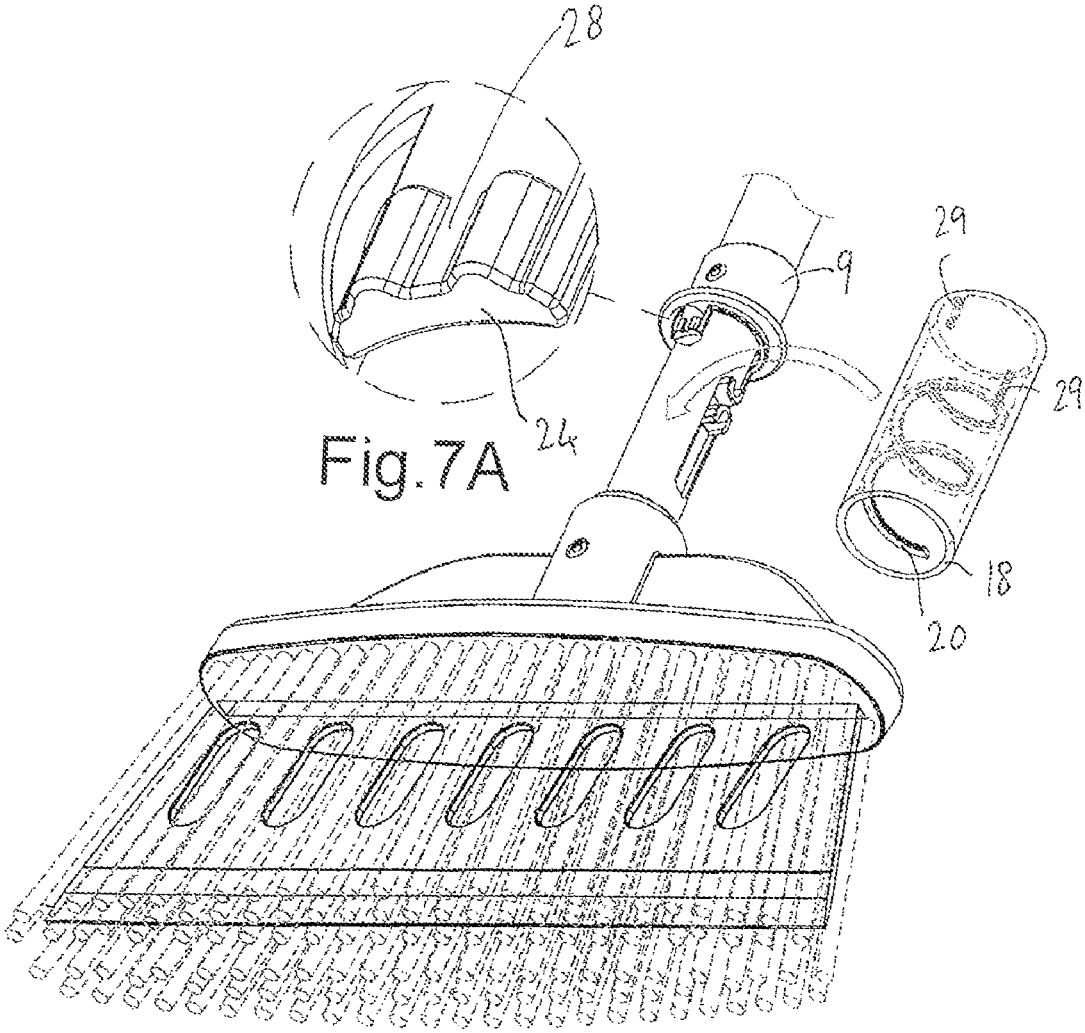
FIG. 7 shows the head and extension mechanism with sleeve removed to show the underlying parts.
FIG. 7A is an enlarged view of the detent formations and the detent groove of the collar of FIG. 7.
Figure 8:
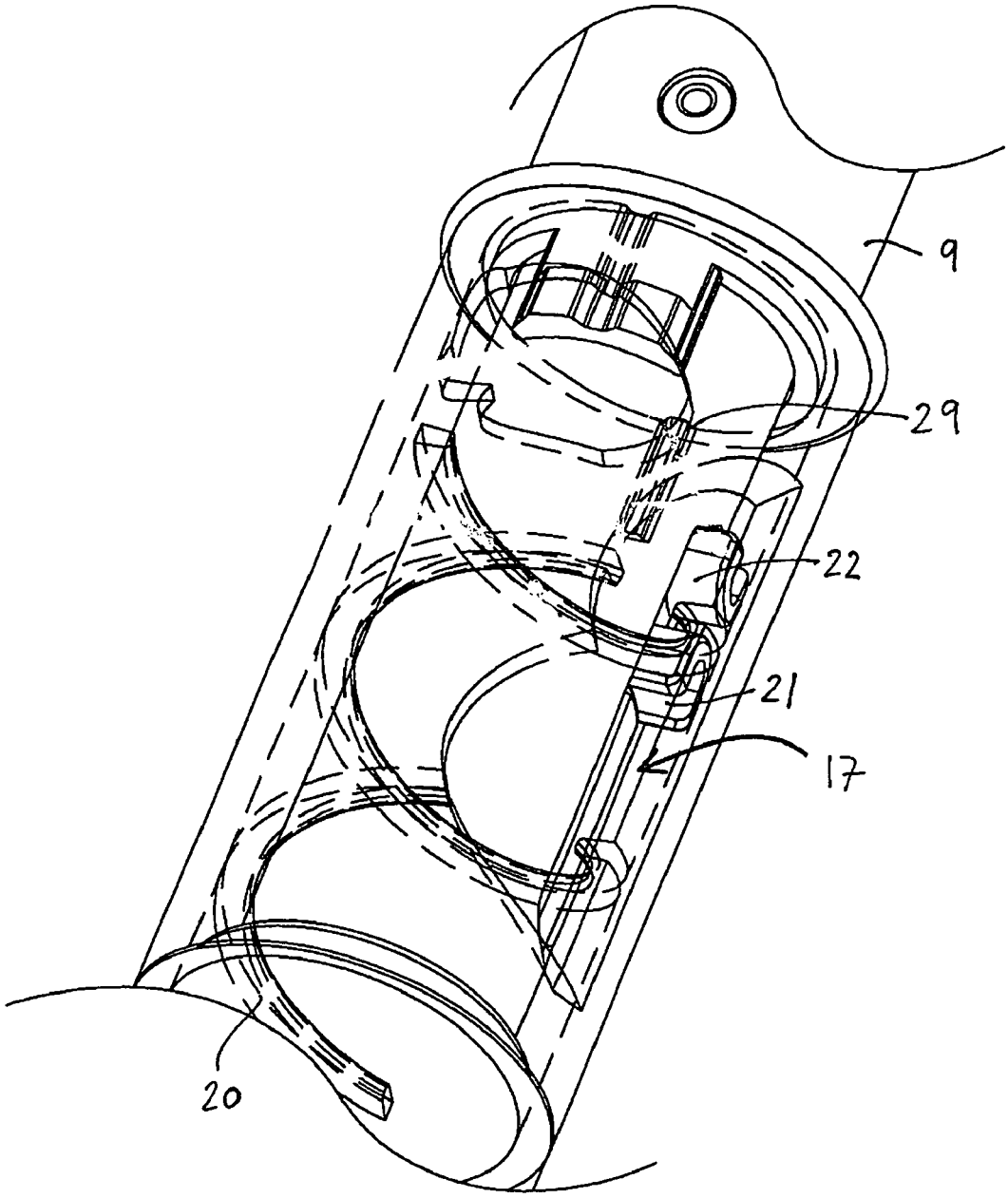
FIG. 8 is an enlarged part cut-away view of part of the implement showing the extension mechanism.

An arrangement of detents may be provided to assist in the attainment of predefined positions of the squeegee blade 8. As best seen in FIGS. 6 and 6A the collar 9 includes a pair of axially depending detent formations 24 each having a pair of raised surfaces 26 defining a detent groove 28 therebetween. Sleeve 18 is provided on its internal surface with a pair of axial ribs 29 arranged on opposite sides of the sleeve 18. The ribs 29 engage within the grooves 28, whereby the sleeve 18 is retained by the detent grooves and can be rotated out of the detents (facilitated by slight flexing of the detent formations 24) through 180° until re-engaging in the opposite detents. It may be arranged that the positions indicated in FIGS. 9(*a*), (*b*) and (*c*) correspond to positions defined by the detent structures. Alternatively the extended and retracted end positions may be defined by the pins 21, 22 abutting the ends of the slot 17.

Figure 2:
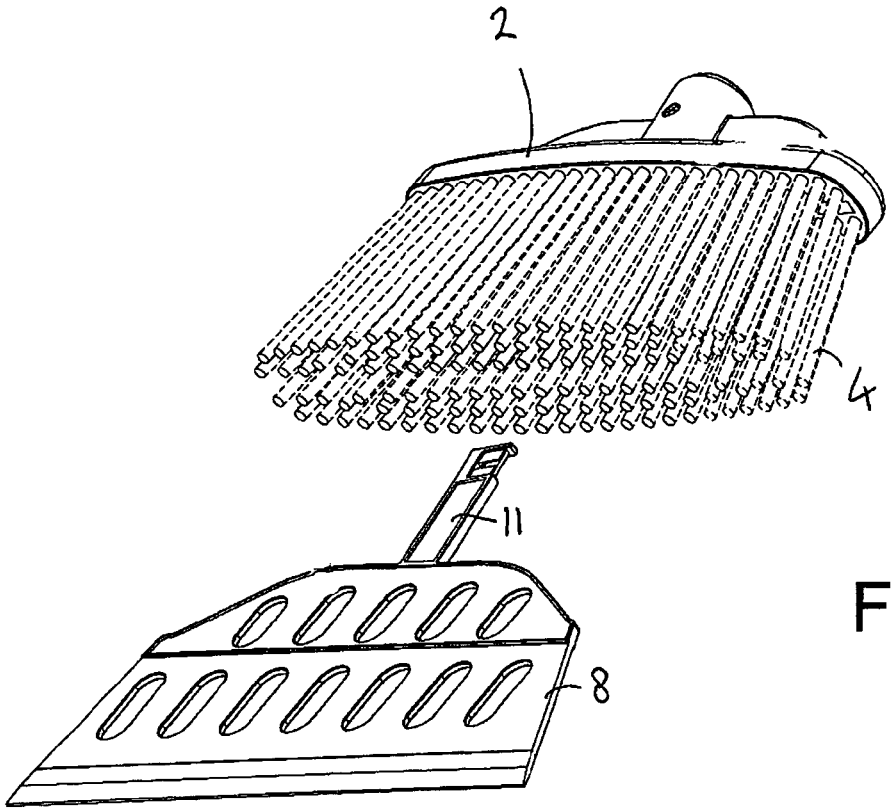
FIG. 2 shows an assembly step for the combined brush/squeegee of a blade member being inserted into a brush head.
Figure 3:
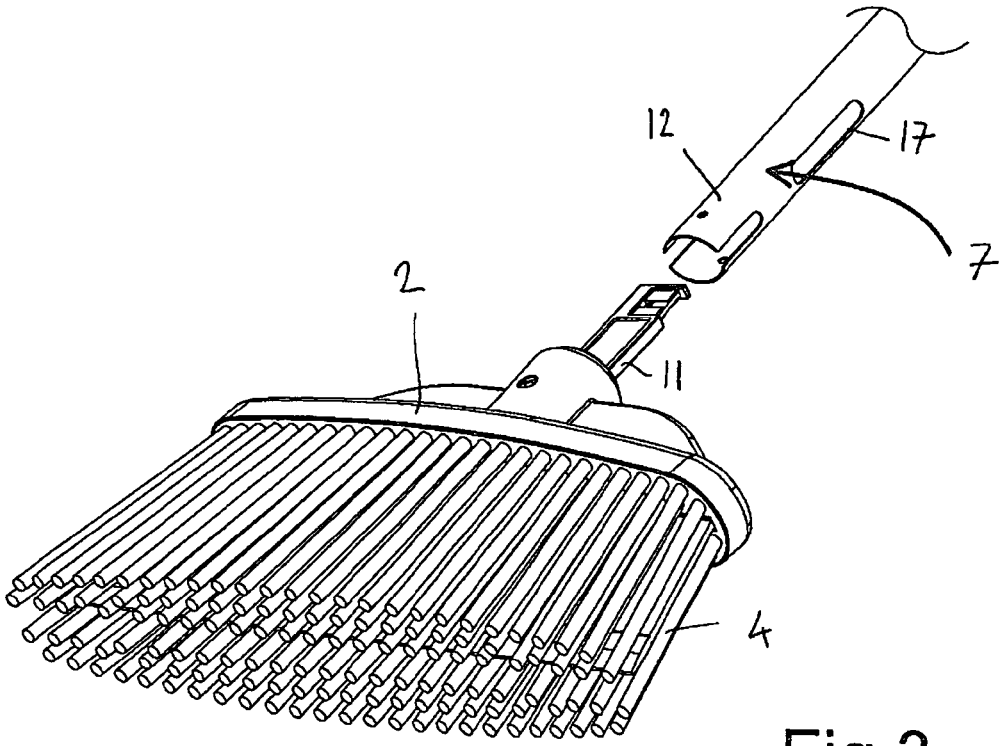
FIG. 3 shows an assembly step of a handle being secured.

FIGS. 2 to 7A illustrate steps in the assembly of the extension mechanism. FIG. 2 shows the blade 8 and its shaft 11 being fitted into the head 2. FIG. 3 shows the head 2 with protruding blade shaft 11 being secured to the handle 7. FIGS. 4 and 4A show the drive member insert 16 being fitted through slot 17 onto the shaft recess 19. FIGS. 5 and 5A show the sleeve 18 being fitted through a twisting action, whereby the cam surface 20 engages between protrusions. FIGS. 6 and 6A show the collar 9 being slid down the handle 7 and secured to the handle by a rivet.

A second embodiment of the cleaning implement is illustrated in FIGS. 10 to 13(*b*)A, in which like parts are indicated with like reference numerals. The combined brush/squeegee includes in similar manner a head 2 with bristles 4 and movable squeegee blade 8 with lower edge 10. An alternative arrangement of extension mechanism is provided. In this embodiment the squeegee blade 8 is driven by an adjustment lever 30 which acts on a link arm 32. More particularly, the upstanding socket indicated 34 extending from the top of the brush head 2 is of greater axial extent and includes a slot 35 with lever 30 pivotably mounted at 36 and extending through the slot 35 so that a longer arm portion 38 of the lever 30 is outside the slot, and a shorter portion 40 is within the socket 34. Shorter arm portion 40 is pivotally joined at 42 to an upper end of link arm 32, the opposite end being joined to a connecting portion 44 provided at an upper end of the squeegee blade 8 by a pivotable connection 46.

Figure 13A:
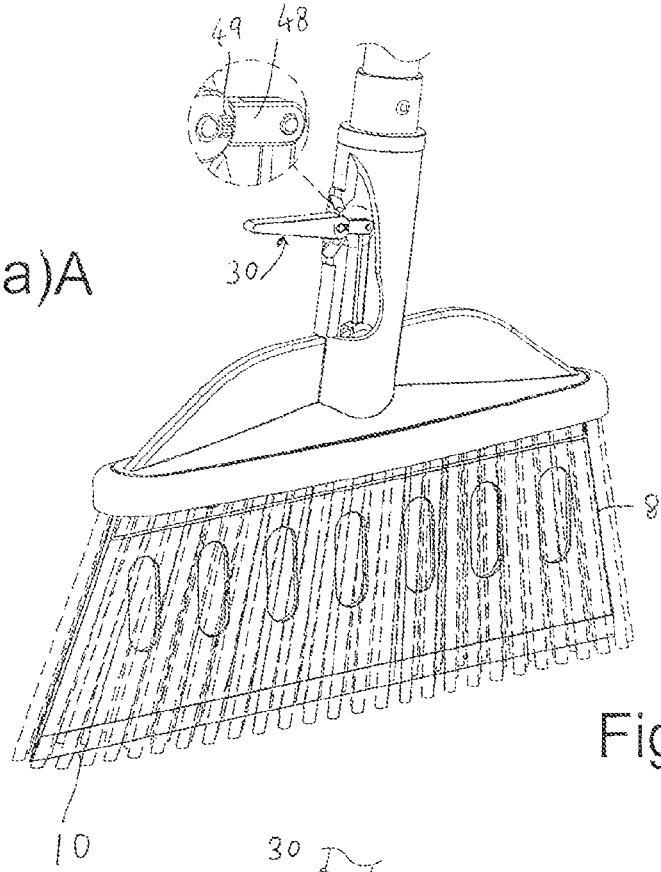
FIGS. 13(*a*) and (*b*) illustrate the progressive extension of the squeegee blade.
Figure 13B:
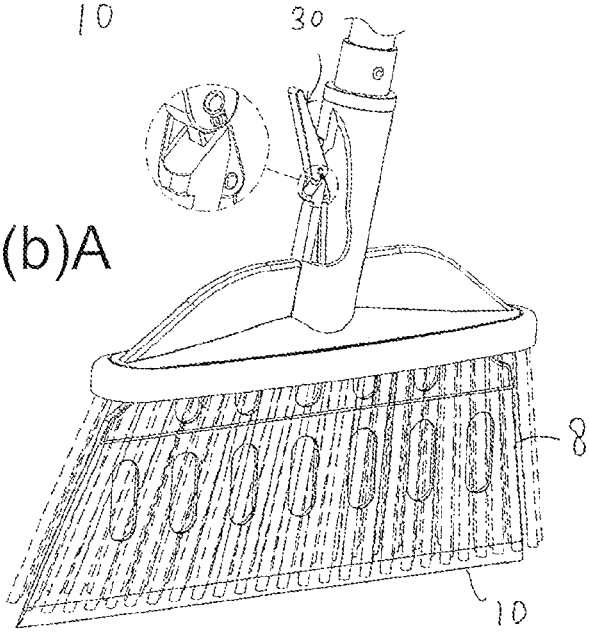

FIGS. 11, 11A and 11B illustrate the lever 30 in a lower position in which the link arm 32 and squeegee blade 8 are in a retracted upper position where the lower blade edge 10 is retracted amongst the bristles 4 and spaced from the bristle ends. FIGS. 13(*a*) and 13(*a*)A illustrate an intermediate position where the lever 30 extends generally perpendicular to the handle 7 and where the blade edge 10 is approximately coplanar with the bristle ends. FIGS. 13(*b*) and 13(*b*)A illustrate an upper position of the lever 30 where the squeegee 8 is extended, with the lower edge 10 extended beyond and spaced from the lower bristle ends.

A detent structure may be provided to assist in holding the lever 30 in predefined positions; a portion of the lever adjacent the pivot 36 may be formed with a recess 49 which interacts with cooperating protrusions 47 on the socket 34 at the edge of the slot, whereby the lever can be retained in the predefined positions. For example, these positions may correspond to the three illustrated positions. It will be appreciated that the positions of protrusions and recesses can be reversed with equal effect.

Figure 14:
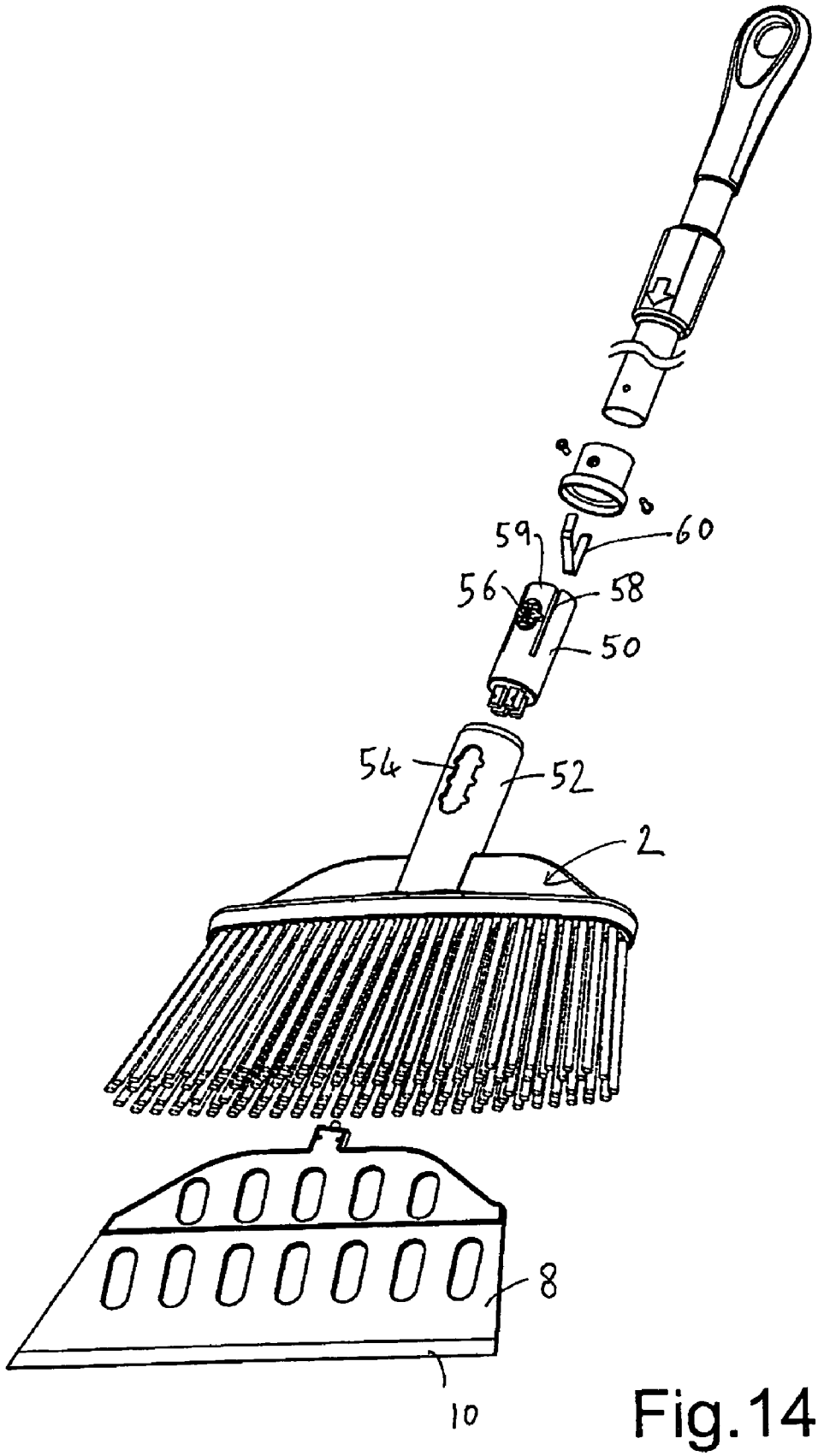
FIG. 14 is an exploded view of a cleaning implement in the form of a combined brush/squeegee in accordance with a third embodiment of the invention.
Figures 15, 15A:
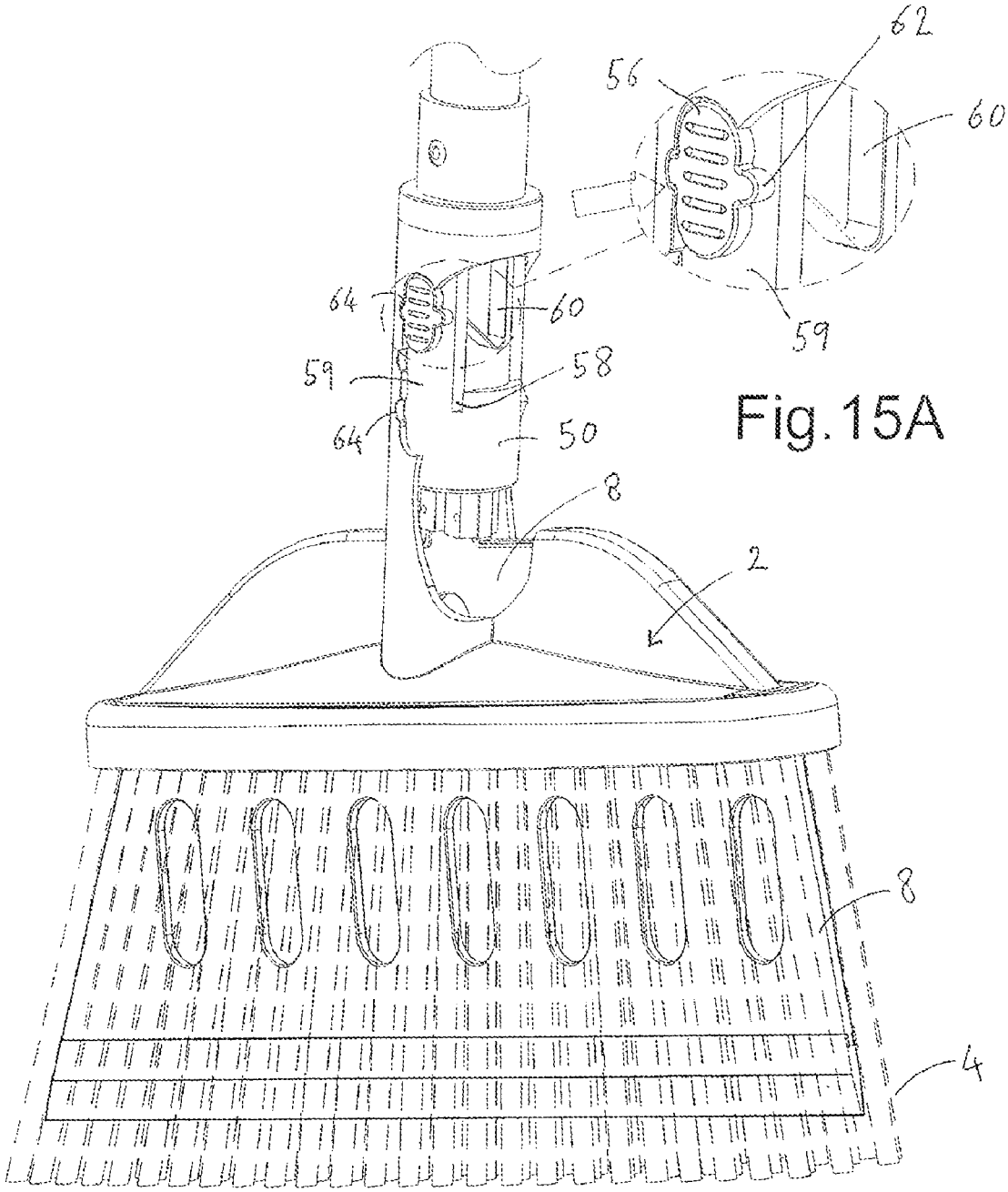
FIG. 15 is an enlarged view of the head and extension mechanism of the combined brush/squeegee of FIG. 14.
FIG. 15A is an enlarged view of a part of a slide member of the extension mechanism of FIG. 15.
Figure 16A:
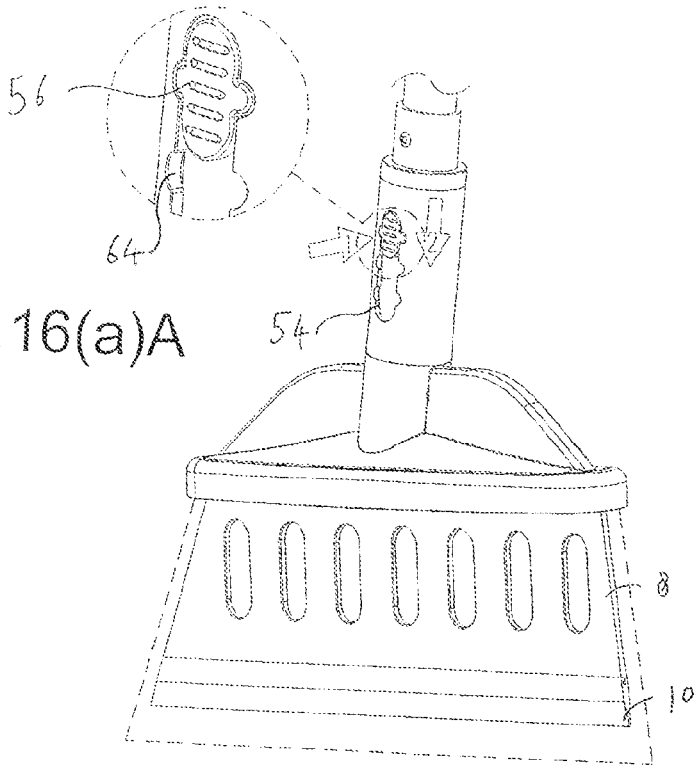
FIGS. 16(*a*), (*b*) and (*c*) illustrate the progressive extension of the squeegee blade of the combined brush/squeegee of this third embodiment.
Figure 16B:
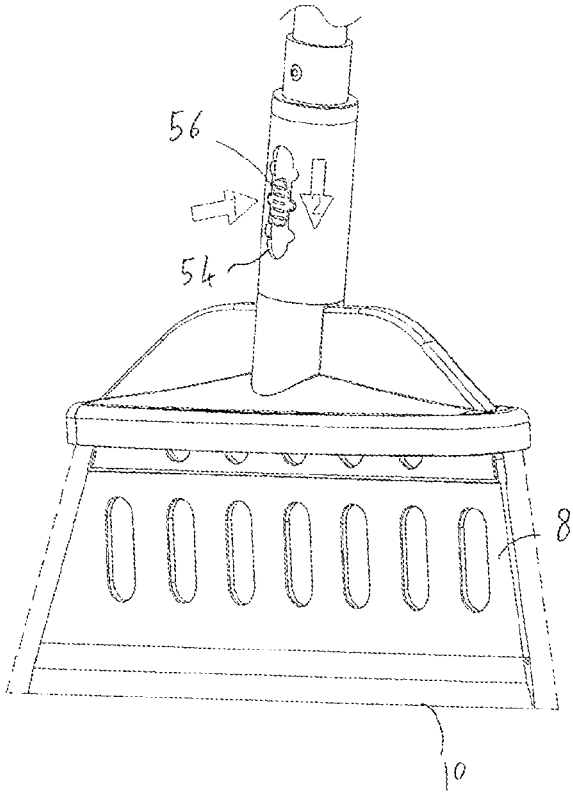
Figure 16C:
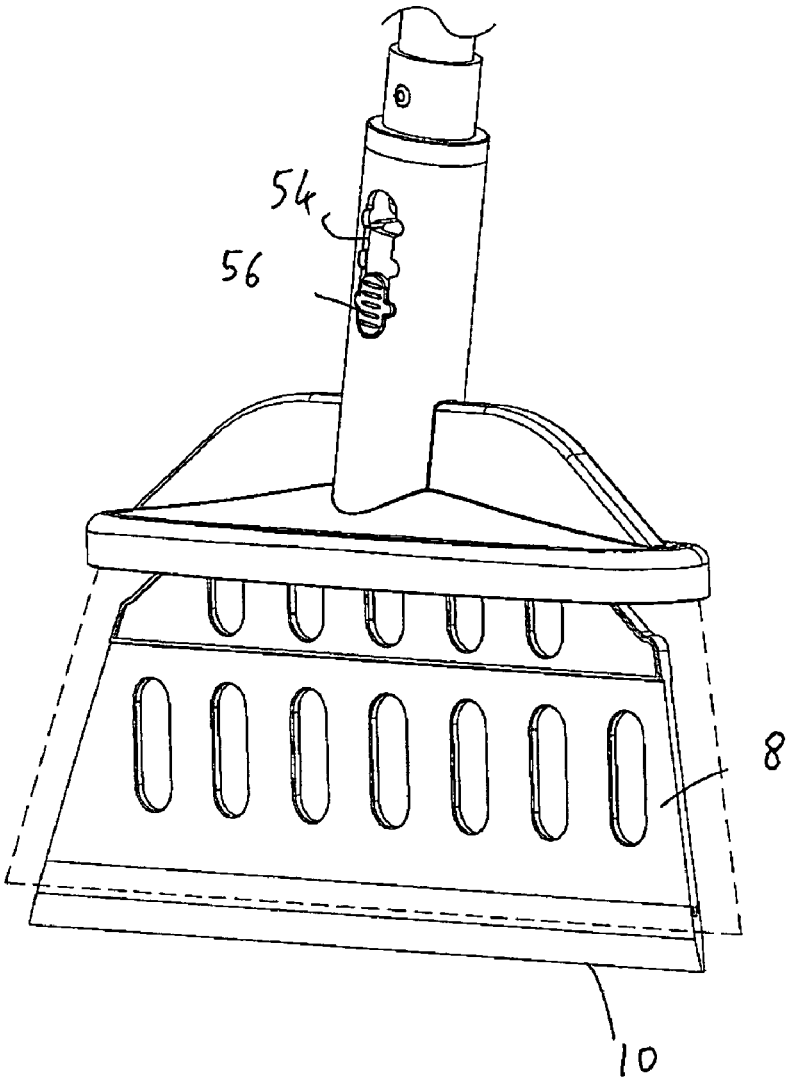

A third embodiment of the cleaning implement is illustrated in FIGS. 14 to 16(*a*) to (*c*), in which like parts are indicated with like reference numerals. The combined brush/squeegee includes in similar manner a head 2 with bristles 4 and movable squeegee blade 8 with lower edge 10. In this embodiment a still further alternative extension mechanism is provided. The movable squeegee blade 8 is driven by a slide member 50 disposed within socket 52, a lower end of which is joined to an upper end of the squeegee blade 8, as can be seen in the cut-away in FIGS. 15 and 15A. Socket 52 is formed with an elongate opening 54 through which protrudes a thumb grip 56 by which the user is able to move the slide member 50.

The slide member 50 is of hollow tubular construction and is formed with a pair of slots 58 on opposite sides of the thumb grip 56, which serve to define a central region 59 which is able to exhibit a degree of inward flexure.

A rear surface of this central region 59 abuts a springy clip 60 which assists in providing an outward return force.

Thumb grip 56 is formed with a pair of laterally directed protruding regions 62. The slot 54 is shaped to define a series of axial positions of the slide member 50, as illustrated defining three axial positions, in which the protruding region 62 can fit into corresponding recessed formations 64 in the edge of the slot 54. As is illustrated in FIGS. 16(*a*) to (*c*) the squeegee blade 8 is moved by depressing the thumb grip 56 inwardly, whereby flexure of the central region 59 of the slide member 50 enables the thump grip 56 to clear the recess and be slid axially up or down between the three positions. As illustrated the upper position of FIG. 16(*a*) corresponds to an upward position where the lower blade edge 10 is retracted within the bristles and spaced froth the bristle ends. The intermediate FIG. 16(*b*) position has the blade edge 10 approximately coplanar with the bristle ends. The lower blade position of FIG. 16(*a*) has the lower blade edge 10 below and spaced from the bristle ends.

The invention claimed is:

1. A cleaning implement comprising:

a head member from which a plurality of bristles extend;

a handle joined to the bristle head member;

a squeegee blade member arranged within or adjacent the bristles and supported so as to be extendable and retractable in a direction generally parallel to the extent of the bristle; and an extension mechanism by which a user can effect movement of the squeegee blade member;

wherein the extension mechanism comprises an outer sleeve member having a helical cam surface, which is rotatably mounted on the handle and which engages with a cam follower on an internal drive member connected to the squeegee blade member, whereby rotation of the outer sleeve member effects linear movement of the squeegee blade member.

2. A cleaning implement according to claim 1 wherein the squeegee blade member is supported so as to be movable between an extended position in which a lower blade edge extends beyond the ends of the bristles, and a retracted position in which the lower blade edge is withdrawn into or beside the bristles and spaced from the bristle ends.

3. A cleaning implement according to claim 1 wherein the squeegee blade member is provided at an upper end with a shaft portion which extends through an opening in the head member to connect with the internal drive member.

4. A cleaning implement according to claim 1 wherein the helical cam surface is formed as an inwardly protruding helical surface, the cam follower comprising a protrusion or pair of protrusions which abut the helical cam surface.

5. A cleaning implement according to claim 4 wherein the handle has an elongate slot-like opening through which the protrusion or pair of protrusions extend.

6. A cleaning implement according to claim 1 wherein the helical cam surface is formed as a recessed track within the sleeve, the cam follower comprising a protrusion engaged within the track.

7. A cleaning implement according to claim 1 wherein a detent structure is provided to retain the outer sleeve in one or more predefined positions associated with predefined positions of the squeegee blade member.

8. A cleaning implement comprising:

a head member from which a plurality of bristles extend;

a handle joined to the head member;

a squeegee blade member arranged within or adjacent the bristles and supported so as to be extendable and retractable in a direction generally parallel to the extent of bristles; and an extension mechanism by which a user can effect movement of the squeegee blade member, the extension mechanism comprising a pivotally mounted lever having a first end which is accessible by a user and an opposite end which is joined to the squeegee blade member, the lever being pivotally supported on a socket portion upstanding from the brush head, extending through a slot with the socket portion, wherein a detent structure is provided whereby the lever can be constrained in one or more predetermined positions, and the detent structure includes one or more recesses or protrusions on the lever which engage with cooperating protrusions or recesses within a wall of the socket defining said slot.

9. A cleaning implement according to claim 8 wherein the opposite end of the lever is joined to the squeegee blade member through a link arm pivotally joined to said opposite end.

10. A cleaning implement comprising:

a head member from which a plurality of bristles extend;

a handle joined to the head member;

a squeegee blade member arranged within or adjacent the bristles and supported so as to be extendable and retractable in a direction generally parallel to the extent of the bristles; and an extension mechanism by which a user can effect movement of the squeegee blade member, wherein the extension mechanism comprises a slide member slidably mounted on the handle or head member, an end of said slide member being joined to the squeegee blade member, and the slide member is mounted within an upstanding handle-receiving socket of the head member, said socket defining an elongate slot-like opening having a slot wall, through which opening a user-controllable thumb grip extends.

11. A cleaning implement according to claim 10 wherein one or more detent positions are defined between the thumb grip and slot wall.

12. A cleaning implement according to claim 11 wherein the thumb grip has a pair of oppositely directed protrusions which engage in one or more recesses with the slot wall.

13. A cleaning implement according to claim 12 wherein the slide member defines a pair of axially-extending slots on opposite side of a central region, said thumb grip portion being provided on the central region, whereby the thumb grip can be bent inwardly so that the protrusions clear the recesses.

* * * * *